US006786981B2

(12) United States Patent
Yazawa et al.

(10) Patent No.: US 6,786,981 B2
(45) Date of Patent: Sep. 7, 2004

(54) FERRITIC STAINLESS STEEL SHEET FOR FUEL TANK AND FUEL PIPE

(75) Inventors: Yoshihiro Yazawa, Chiba (JP); Mineo Muraki, Chiba (JP); Yoshihiro Ozaki, Chiba (JP); Kunio Fukuda, Chiba (JP); Atushi Miyazaki, Chiba (JP); Yasushi Katoh, Chiba (JP)

(73) Assignee: JFE Steel Corporation (JP)

( * ) Notice: Subject to any disclaimer, the term of this patent is extended or adjusted under 35 U.S.C. 154(b) by 75 days.

(21) Appl. No.: 10/016,543

(22) Filed: Dec. 11, 2001

(65) Prior Publication Data

US 2002/0117240 A1 Aug. 29, 2002

(30) Foreign Application Priority Data

Dec. 22, 2000 (JP) ..... 2000-391108
Apr. 4, 2001 (JP) ..... 2001-105483

(51) Int. Cl.[7] ..... C22C 38/44; C22C 38/46
(52) U.S. Cl. ..... 148/325; 420/68; 420/69
(58) Field of Search ..... 148/325; 420/68, 420/69

(56) References Cited

U.S. PATENT DOCUMENTS 5,110,544 A * 5/1992 Sato et al. ..... 420/68
5,302,214 A * 4/1994 Uematsu et al. ..... 148/325

FOREIGN PATENT DOCUMENTS

| | | |
|---|---|---|
| EP | 0 450 464 A1 | 10/1991 |
| EP | 0 930 375 A | 7/1999 |
| JP | 61 149385 | 7/1987 |

* cited by examiner

*Primary Examiner*—Deborah Yee
(74) *Attorney, Agent, or Firm*—Piper Rudnick LLP

(57) ABSTRACT

A ferritic stainless steel sheet for fuel tanks and fuel pipes comprises, by mass percent, about 0.1% or less of C; about 1.0% or less of Si; about 1.5% or less of Mn; about 0.06% or less of P; about 0.03% or less of S; about 1.0% or less of Al; about 11% to about 20% Cr; about 2.0% or less of Ni; about 0.5% to about 3.0% Mo; about 0.02% to about 1.0% V; about 0.04% or less of N; at least one of about 0.01% to about 0.8% Nb and about 0.01% to about 1.0% Ti; and the balance being Fe and incidental impurities. The ferritic stainless steel sheet is produced by rough-rolling a slab having the above composition; hot-rolling the rough-rolled sheet under a linear pressure of at least about 3.5 MN/m at a final pass in the finish rolling; cold-rolling the hot-rolled sheet at a gross reduction rate of at least about 75%; and annealing the cold-rolled sheet. The cold-rolling step includes one rolling stage or at least two rolling stages including intermediate annealing.

4 Claims, 3 Drawing Sheets

FERRITIC STAINLESS STEEL SHEET FOR FUEL TANK AND FUEL PIPE

BACKGROUND

1. Field of the Invention

This invention relates to ferritic stainless steel sheets suitable for containers and piping elements for organic fuels such as gasoline, methanol and the like. In particular, the invention relates to a ferritic stainless steel sheet which can be readily shaped into fuel tanks and fuel pipes and which is resistant to organic fuels, particularly deteriorated gasoline containing organic acids produced in the ambient environment. The invention also relates to a method for making the ferritic stainless steel sheet.

2. Description of the Related Art

Automobile fuel tanks are generally manufactured by plating surfaces of a soft steel sheet with a lead alloy and shaping and welding the terne coated steel sheet. The continued use of lead-containing materials, however, tends to be severely limited with the increasing sensitivity to environmental issues.

Several substitutes for the terne coated steel sheet have been developed. Unfortunately, the substitutes have the following problems. Al—Si plating materials as lead-free plating materials are unreliable in weldability and long-term corrosion resistance and, thus, are used only in restricted fields. Although resinous materials have been tried for uses in fuel tanks, industrial use of the resinous materials which are inevitably permeable to fuel is limited under circumstances such as regulations against fuel transpiration and recycling. Also, the use of austenitic stainless steels, which requires no lining treatments, has been attempted. Although the austenitic stainless steels exhibit superior processability and higher corrosion resistance compared with the ferritic stainless steels, the austenitic stainless steels are expensive for fuel tanks and have the possibility of stress corrosion cracking (SCC). Thus, the austenitic stainless steels have not yet been used in practice.

In contrast, the ferritic stainless steels not containing nickel are advantageous in material costs compared with the austenitic stainless steels, but do not exhibit satisfactory corrosion resistance to so-called "deteriorated gasoline" containing organic acids such as formic acid and acetic acid which are formed in the ambient environment. Furthermore, the ferritic stainless steels do not exhibit sufficient processability to deep drawing for forming fuel tanks having complicated shapes and to expanding and bending of the pipes for forming expanded fuel pipes and bent fuel pipes.

Japanese Unexamined Patent Publication Nos. 6-136485 and 6-158221 disclose double-layer steel sheets each including a corrosion-resistant steel layer and a low-carbon or ultra-low-carbon steel layer having excellent processability to achieve both corrosion resistance and processability. However, the double-layer steel sheets exhibit less adaptability to mass production.

SUMMARY OF THE INVENTION

The invention provides a ferritic stainless steel sheet which exhibits superior processability and high corrosion resistance to deteriorated gasoline and is useful for automobile fuel tanks and fuel pipes. In particular, the ferritic stainless steel of the invention has a thickness in the range of about 0.4 to about 1.0 mm and superior deep drawing processability, namely, an revalue of at least about 1.50 and preferably at least about 1.90.

The r-value in the invention represents a mean plastic strain ratio determined by equation (1) according to Japanese Industrial Standard (JIS) Z2254:

$$r = \frac{r_0 + 2r_{45} + r_{90}}{4}$$

wherein, $r_0$ is a plastic strain ratio measured using a test piece which is sampled in parallel to the rolling direction of the sheet;

$r_{45}$ is a plastic strain ratio measured using a test piece which is sampled at 45° to the rolling direction of the sheet; and $r_{90}$ is a plastic strain ratio measured using a test piece which is sampled at 90° to the rolling direction of the sheet.

An r-value of less than about 1.50 precludes deep drawing into a complicated fuel tank shape and bending into a complicated bent pipe shape and exhibits high impact brittleness (secondary processing brittleness) even if the sheet is capable of processing.

The invention also provides a ferritic stainless steel having a surface ridging height of about 50 μm or less at 25% deformation in uniaxial stretching. Ridges formed during processing of steel sheets for automobile fuel tanks are not necessarily so small because these tanks are produced by press forming of the sheet. According to our investigations, however, ridges cause cracking of the sheet during severe press forming processes which are used in the production of fuel tanks. Hence, the ridging height must be small. The ridges generated in the sheeting process vary the state of contact of the unprocessed steel sheet piece with the press die and results in "gnawing" or "galling" due to a local deficiency of lubricant oil film. The gnawing also causes cracking along the ridges.

According to our further investigations, a steel sheet exhibiting superior press formability suitable for processing of fuel tanks having complicated shapes has a surface ridging height of about 50 μm or less at a 25% deformation in uniaxial stretching. Herein, the ridges on the steel sheet generated during processing are evaluated by the height of the ridges in a direction perpendicular to the stretching direction when the steel is stretched in the rolling direction.

The invention also solves a problem in the art known in the case of severe forming of a ferritic stainless steel into fuel tanks and fuel pipes and in the case of lubricant-free press forming. That is, the invention provides a ferritic stainless steel by a lubricant-free process exhibiting superior deep drawability and requires no lubrication steps for treating the sheet with lubricant oil.

We discovered that a predetermined amount of a lubricant coat primarily containing an acrylic resin which is applied on the surfaces of a ferritic stainless steel sheet decreases the dynamic friction coefficient between the steel sheet and the press die, thus preventing "gnawing" and being capable of processing into articles having further complicated shapes.

We intensively investigated the effects of the composition of ferritic stainless steel sheets and the method for making the same on the corrosion resistance in deteriorated gasoline and the r-value of the ferritic stainless steel sheet and found that the corrosion resistance to the deteriorated gasoline is remarkably improved by adding appropriate amounts of Mo and V to the steel sheets.

Since the addition of Mo precludes processability, we further investigated the r-value as a reference of processability of Mo-containing steel sheets and found that a high revalue is achieved by a specified method.

Furthermore, we found that optimized annealing conditions for hot-rolled ferritic stainless steel sheets minimize the ridging height, provide superior press formability, and that the application of a lubricant coat on the steel sheet surfaces improves sliding performance in forming, decreases the dynamic friction coefficient between the steel sheet and the press die, and facilitates forming of articles having further complicated shapes.

According to an aspect of the invention, a ferritic stainless steel sheet for fuel tanks and fuel pipes comprises, by mass percent, about 0.1% or less of C; about 1.0% or less of Si; about 1.5% or less of Mn; about 0.06% or less of P; about 0.03% or less of S; about 1.0% or less of Al; about 11% to about 20% Cr; about 2.0% or less of Ni; about 0.5% to about 3.0% Mo; about 0.02% to about 1.0% V; about 0.04% or less of N; at least one of about 0.01% to about 0.8% Nb and about 0.01% to about 1.0% Ti; and the balance being Fe and incidental impurities.

Preferably, the ferritic stainless steel sheet has a ridging height of about 50 $\mu$m or less at a 25% deformation in uniaxial stretching.

Preferably, a lubricant coat comprising an acrylic resin, calcium stearate, and polyethylene wax is coated by baking on the surfaces of the ferritic stainless steel sheet in a coating amount of about 0.5 g/m$^2$ to 4.0 g/m$^2$.

According to another aspect of the invention, a method for making a ferritic stainless steel sheet for fuel tanks and fuel pipes, comprises the steps of rough-rolling a slab comprising, by mass percent, about 0. 1% or less of C, about 1.0% or less of Si, about 1.5% or less of Mn, about 0.06% or less of P, about 0.03% or less of S, about 1.0% or less of Al, about 11% to about 20% Cr, about 2.0% or less of Ni, about 0.5% to about 3.0% Mo, about 0.02% to about 1.0% V, about 0.04% or less of N, at least one of about 0.01% to about 0.8% Nb and about 0.01% to about 1.0% Ti, and the balance being Fe and incidental impurities; hot-rolling the rough-rolled sheet under a linear pressure of at least about 3.5 MN/m at a final pass in the finish rolling; cold-rolling the hot-rolled sheet at a gross reduction rate of at least about 75%, the cold-rolling step including one rolling stage or at least two rolling stages including intermediate annealing; and annealing the cold-rolled sheet.

Preferably, the hot-rolled sheet is subjected to hot-rolled sheet annealing according to the following equations:

$$900 \leqq T+20t \leqq 1{,}150 \text{ and } t \leqq 10$$

wherein T is the annealing temperature (° C.) and t is the holding time (minutes).

Preferably, a lubricant coat comprising an acrylic resin, calcium stearate, and polyethylene wax is coated by baking on the surfaces of the hot-rolled or annealed hot-rolled sheet in a coating amount of about 0.5 g/m$^2$ to about 4.0 g/m$^2$.

DESCRIPTION OF PREFERRED EMBODIMENTS

Figure 1:
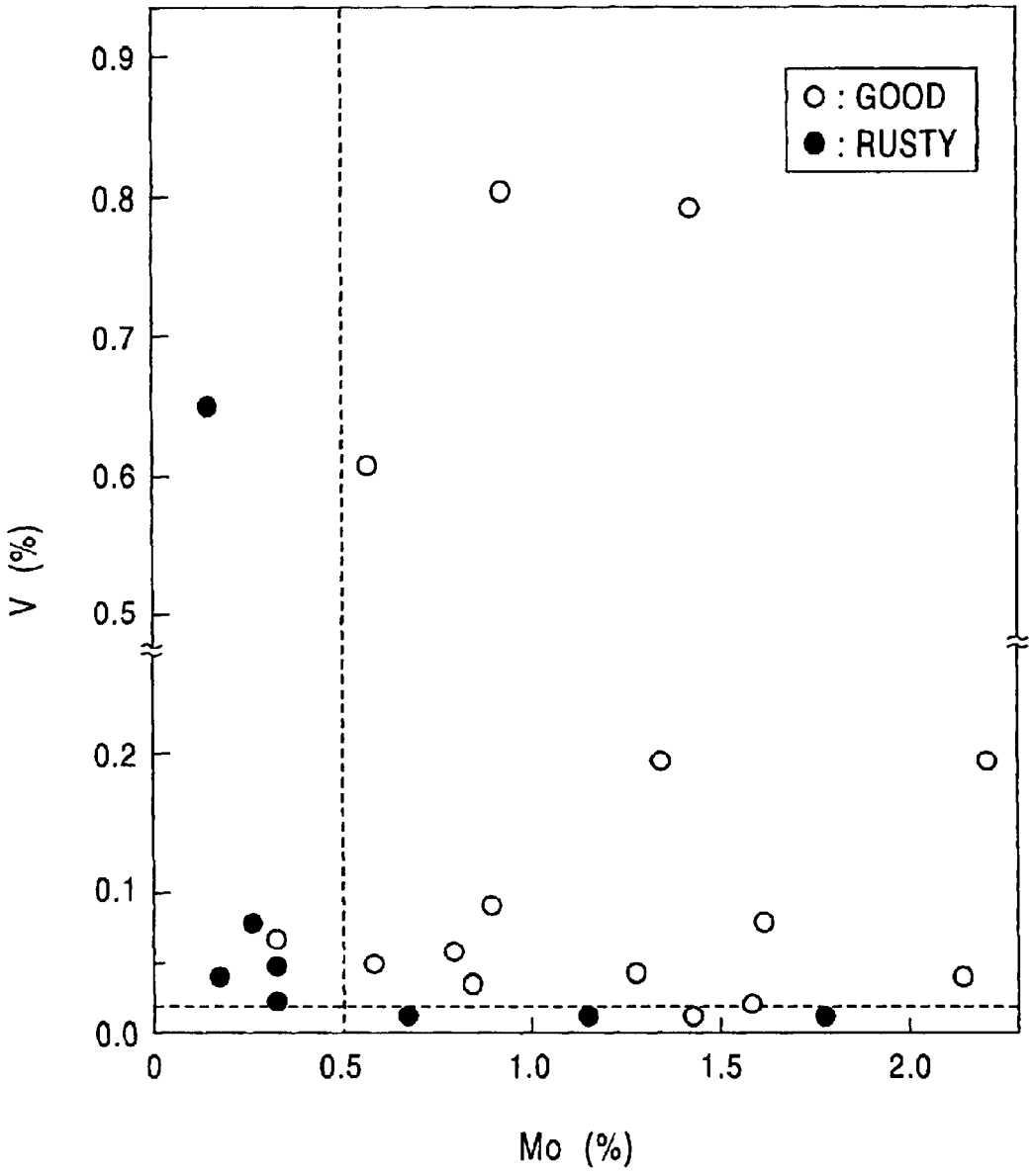
FIG. 1 is a graph illustrating the effects of the Mo and V contents in ferritic stainless steel sheets on the corrosion resistance in the deteriorated gasoline.

Reasons for limitation of the composition and process conditions of the ferritic stainless steel sheet according to the invention will now be described. The content of each component is represented by mass percent (hereinafter merely referred to as percent or %).

C: about 0.1% or less

Although a required amount of carbon (C) is added to strengthen grain boundaries and to enhance brittle resistance to secondary processing, excess carbon precipitates at grain boundaries as carbides which adversely affect brittle resistance to secondary processing and corrosion resistance at grain boundaries. Since these adverse affects are noticeable at a C content exceeding about 0.1%, the C content is limited to be about 0.1% or less. The C content is preferably in the range of more than about 0.002% to about 0.008% in view of an improvement in brittle resistance in secondary processing.

Si: about 1.0% or less

Silicon (Si) contributes to improved oxidation and corrosion resistance and, thus, improved corrosion resistance on the outer and inner surfaces of a fuel tank. In order to achieve such effects, the Si content is preferably about 0.2% or more. However, a Si content exceeding about 1.0% causes the embrittlement of the steel sheet and the deterioration of brittle resistance in secondary processing at the weld. Thus, the Si content is about 1.0% or less and preferably about 0.75% or less.

Mn: about 1.5% or less

Manganese (Mn) improves oxidation resistance. Although about 0.5% or more of Mn is preferably used to achieve such an effect, an excess amount of Mn causes the deterioration of toughness of the steel sheet and the deterioration of brittle resistance in the secondary processing at the weld. Thus, the Mn content is about 1.5% or less and preferably about 1.30% or less.

P: about 0.06% or less

Phosphorus (P) readily precipitating at grain boundaries decreases the strength at the grain boundaries after severe processing such as deep drawing for making fuel tanks. Thus, the P content is preferably as low as possible to improve brittle resistance in secondary processing (resistance to cracking by slight impact after severe processing). Since a significantly low P content results in an increase in production cost of steel-making process, the P content is about 0.06% or less and more preferably about 0.03% or less.

S: about 0.03% or less

Although sulfur (S) precludes corrosion resistance of the stainless steel, about 0.03% is allowable as the upper limit in view of desulfurization cost in of steel-making process. Preferably, the S content is about 0.01% or less which can be fixed by Mn and Ti.

Al: about 1.0% or less

Although aluminum (Al) is an essential element as a deoxidizer in the steel-making process, an excess amount of aluminum causes deterioration of surface appearance and corrosion resistance due to inclusions. Thus, the Al content is limited to be about 1.0% or less and preferably about 0.50% or less.

Cr: about 11% to 20%

At least about 11% chromium (Cr) must be contained in the steel to achieve sufficient brittle and corrosion resistance. On the other hand, a Cr content exceeding about 20% results in the deterioration of processability due to increased strength and decreased ductility even if the r-value is high. Thus, the Cr content is in the range of about 11% to about 20%. Preferably, the Cr content is about 14% or more and more preferably in the range of about 14% to about about 18%, in view of corrosion resistance at the weld.

Ni: about 2.0% or less

At least about 0.2% nickel (Ni) is preferably contained to improve the corrosion resistance of the stainless steel. An amount exceeding about 2.0% nickel causes hardening of the steel and stress corrosion cracking due to the formation of an austenite phase. Thus, the Ni content is about 2.0% or less and preferably in the range of about 0.2% to about 0.8%.

Mo: about 0.5% to 3.0%

Molybdenum (Mo), as well as vanadium (V), is effective in an improvement in corrosion resistance to deteriorated gasoline. At least about 0.5% Mo is required to achieve superior corrosion resistance to deteriorated gasoline. However, a Mo content exceeding about 3.0% results in deterioration of processability due to precipitation formed during annealing. Thus, the Mo content is in the range of about 0.5% to about 3.0% and preferably about 0.7% to about 1.6%.

V: about 0.02% to 1.0%

Vanadium (V) is effective in an improvement in corrosion resistance to deteriorated gasoline by a combination with molybdenum (Mo). Such an improvement is observed at a V content of at least about 0.02%. However, a V content exceeding about 1.0% results in the deterioration of processability due to precipitation during annealing. Thus, the V content is in the range of about 0.02% to about 1.0% and preferably about 0.05% to about 0.3%.

The relationships between the Mo and V contents and the corrosion resistance to deteriorated gasoline will now be described. FIG. 1 is a graph illustrating the relationships between the Mo and V contents in ferritic stainless steel sheets and the corrosion resistance. The ferritic stainless steel sheets contains about 0.003% to about 0.005% C, about 0.07% to about 0.13% Si, about 0.15% to about 0.35% Mn, about 0.02% to about 0.06% P, about 0.01% to about 0.03% S, about 14.5% to about 18.2% Cr, about 0.2% to about 1.0% Ni, about 0.02% to about 0.04% Al; about 0.001% to about 0.45% Nb, about 0.3% to about 0.5% Ti, and about 0.004% to about 0.011% N, and the corrosion resistance is measured in a deteriorated gasoline containing 800 ppm of formic acid for 120 hours. In the graph, the symbol ○ represents that the appearance after the corrosion resistance test in the deteriorated gasoline does not change, and the symbol ● represents that the surface red rust is observed.

FIG. 1 shows that samples containing both Mo and V and having a Mo content of about 0.5% or more and a V content of about 0.02% or more exhibit high corrosion resistance in the deteriorated gasoline.

N: about 0.04% or less

Although nitrogen (N) strengthens grain boundaries which improves brittle resistance in secondary processing for making tanks and the like, an excess amount of nitrogen precipitates at the grain boundaries as nitrides which adversely affects corrosion resistance. Thus, the N content is about 0.04% or less and preferably about 0.020% or less.

Nb: about 0.01% to about 0.8% and Ti: about 0.01% to about 1.0%

Niobium (Nb) and titanium (Ti) fix carbon and nitrogen in a solid-solution state as compounds to increase the r-value. The content of each element to fix carbon and nitrogen is about 0.01% or more. These elements may be contained alone or in combination. A Nb content exceeding about 0.8% causes remarkable deterioration of toughness, and a Ti content exceeding about 1.0% causes deterioration of the surface appearance and toughness. Preferably, the Nb content is in the range of about 0.05% to about 0.4% and the Ti content is in the range of about 0.05% to about 0.40%.

The ferritic stainless steel sheet of the invention may further contain about 0.3% or less of cobalt (Co) and about 0.01% or less of boron (B) to improve brittle resistance in secondary processing. Moreover, the ferritic stainless steel sheet may contain the following incidental impurities: about 0.5% or less of zirconium (Zr), about 0.1% or less of calcium (Ca), about 0.3% or less of tantalum (Ta), about 0.3% or less of tungsten (W), about 1% or less of copper (Cu), and about 0.3% or less of tin (Sn), as long as the steel sheet exhibits the above-described advantages.

The ferritic stainless steel sheet according to the invention may be produced by a known method which is generally employed in production of ferritic stainless steel sheets. However, conditions for hot rolling and cold rolling are partly changed, as described below. In steel making, preferably, steel containing the above essential components and auxiliary components added according to demand is produced in a converter or electric furnace and the steel is subjected to secondary refinement by vacuum oxygen decarbonization (VOD). The molten steel may be subjected to any known casting process and preferably a continuous casting process in view of productivity and quality. The steel material obtained by the continuous casting process is heated to a temperature between about 1,000° C. and about 1,250° C. and hot-rolled to form a hot-rolled steel sheet having a desired thickness.

The linear pressure at the final pass in the hot rolling is at least about 3.5 MN/m to continuously produce a steel sheet having a high r-value. The linear pressure represents a pressure during rolling divided by the sheet width. A larger linear pressure is considered to continuously obtain a high r-value because strain is accumulated in the steel sheet. A large linear pressure is achieved by any combination of a decrease in hot rolling temperature, high-alloy formulation, an increase in hot rolling speed, and an increase in roller diameter.

The resulting hot-rolled sheet is, if necessary and preferably, subjected to continuous annealing (hot-rolled sheet annealing) at a temperature in the range of about 900° C. to about 1,100° C., pickling, and cold rolling to form a cold-rolled sheet. The cold rolling step may include at least two cold rolling stages including an intermediate annealing for production procedure reasons, if necessary. In order to produce a steel sheet having a high r-value, the above-described linear pressure at the final pass in the hot rolling must be secured and the gross reduction rate in the cold rolling step including one cold rolling stage or two cold rolling stages must be at least about 75% and more preferably at least about 82%.

The cold-rolled sheet is preferably subjected to continuous annealing (cold-rolled sheet annealing) at a temperature in the range of about 800° C. to about 1,100° C. and pickling to form a cold-rolled annealed sheet as the final product. The cold-rolled annealed sheet may be subjected to slight rolling to adjust the shape and quality of the steel sheet according to the usage.

Figure 2:
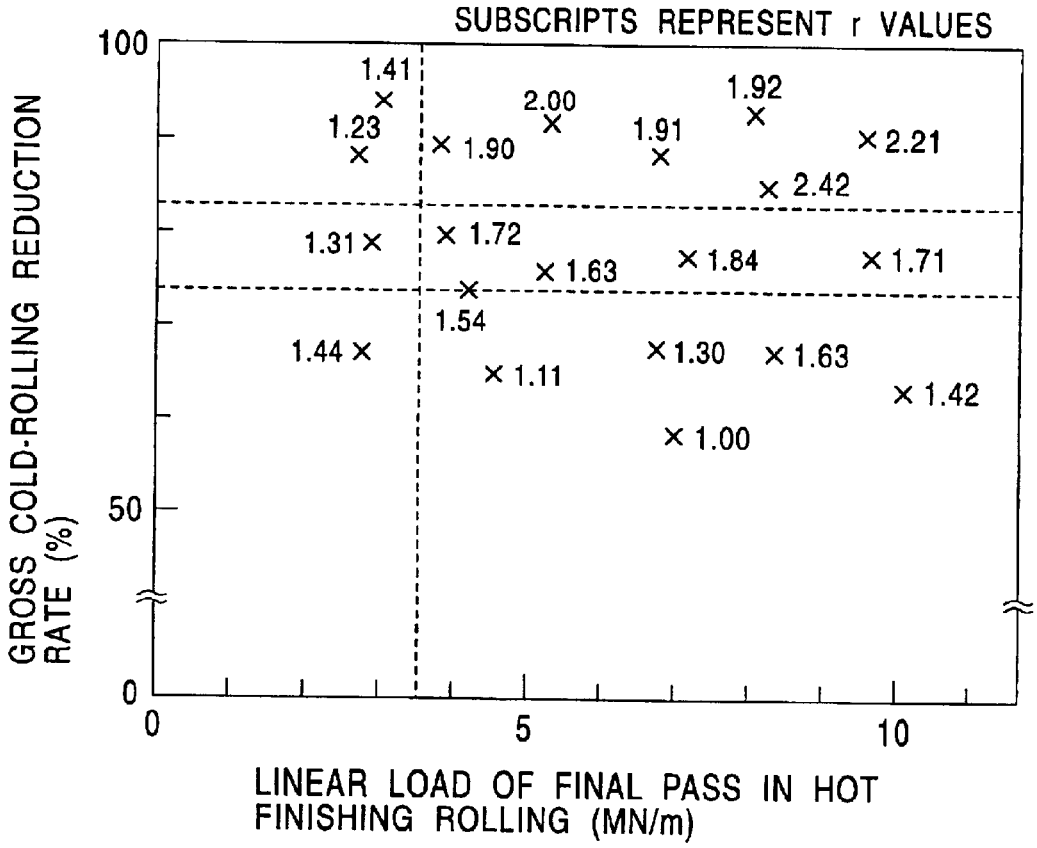
FIG. 2 is a graph illustrating the effects of the linear pressure at the final pass in the finish rolling and the gross cold-rolling reduction rate on the revalue of the final product.

FIG. 2 is a graph illustrating the effects of the linear pressure at the final pass in the finish hot rolling of slabs and the gross reduction rate of the subsequent cold rolling on the r-value of the final product in which the slab contains about 0.003% to about 0.005% C, about 0.07% to about 0.13% Si, about 0.15% to about 0.35% Mn, about 0.02% to about 0.06% P, about 0.01% to about 0.03% S, about 14.5% to about 18.2% Cr, about 0.2% to about 1.0% Ni, about 0.5% to about 1.6% Mo, about 0.02% to about 0.43% V, about 0.02% to about 0.04% Al, about 0.001% to about 0.45% Nb, about 0.3% to about 0.5% Ti, about 0.004% to about 0.011% N, and the balance substantially being Fe.

FIG. 2 shows that a high r-value is always achieved at a linear pressure at the hot-rolling final pass of at least about 3.5 MN/m and a gross cold-rolling reduction rate of at least about 75% in high-alloy steels containing at least about 0.5% Mo.

The method for making the steel sheet according to the invention will now be described. The steel sheet according to the invention is produced by a known method employed in production of ferritic stainless steel sheets, but the production conditions are partly modified. That is, the cold-rolled annealed steel sheet is produced through steel making, hot rolling, annealing, pickling, cold rolling and finish annealing.

Steel having the above composition is produced in a converter or electric furnace and the melt subjected to secondary refinement by VOD. The molten steel may be subjected to any known casting process and, preferably, a continuous casting process in view of productivity and quality. The steel material obtained by the continuous casting process is heated to a temperature between about 1,000° C. and about 1,250° C. and hot-rolled to form a hot-rolled steel sheet having a desired thickness.

The hot-rolled sheet is annealed. Annealing conditions are essential for continuous production of steel sheets having low ridging height and superior press formability. The annealing temperature T (° C.) and the holding time t (minutes) are determined so as to satisfy the relationship $900 \leqq T+20t \leqq 1{,}150$. Continuous heating furnaces are generally used in industrial facilities. The holding time t is preferably about 10 minutes or less in view of productivity and controllability.

Figure 3:
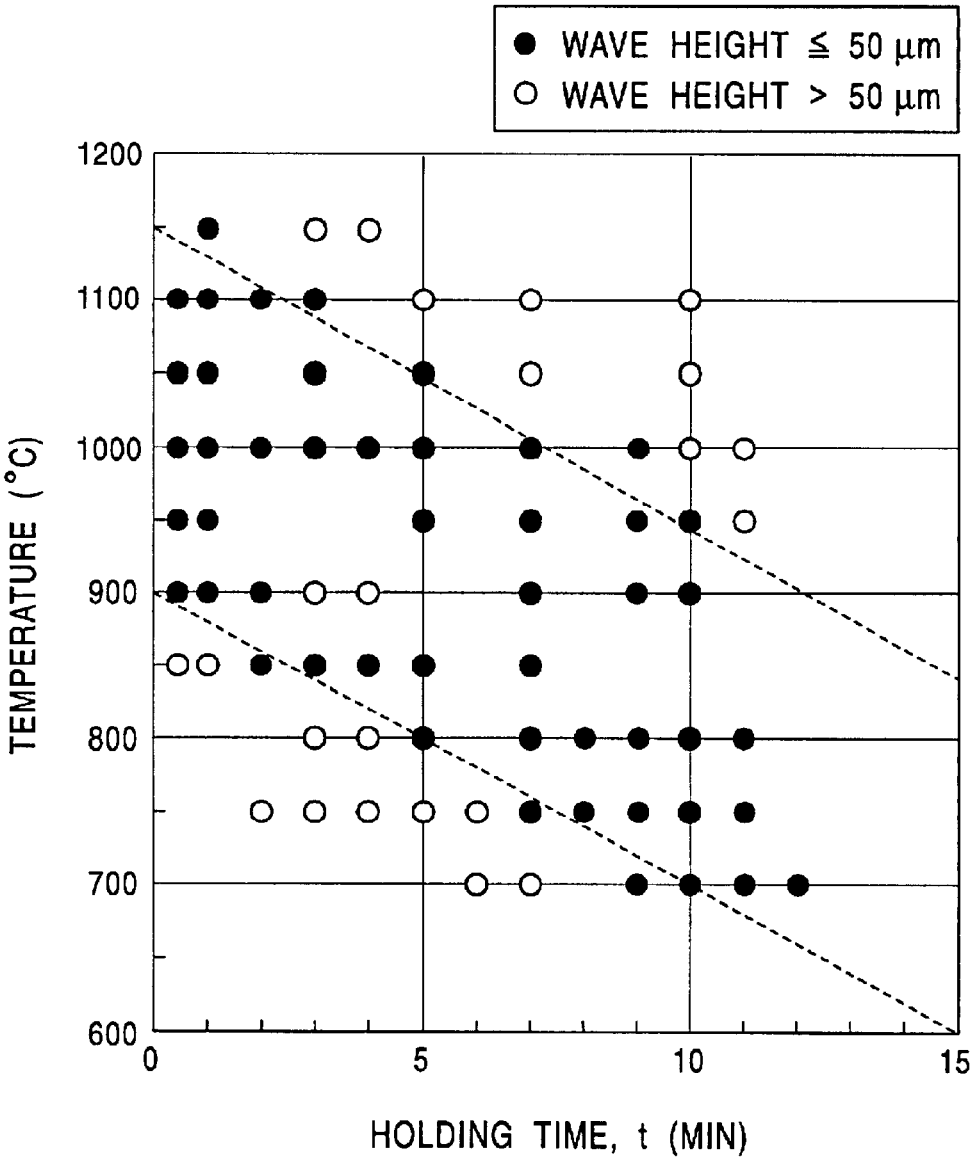
FIG. 3 is a graph illustrating the effects of the hot-rolled sheet annealing condition on the ridging height.

FIG. 3 is a graph illustrating the effects of the hot-rolled sheet annealing condition on the ridging height of a ferritic stainless steel sheet containing about 0.003% to about 0.005% C, about 0.07% to about 0.13% Si, about 0.15% to about 0.35% Mn, about 0.02% to about 0.06% P, about 0.01% to about 0.03% S, about 14.5% to about 18.2% Cr, about 0.2% to about 1.0% Ni, about 0.5% to about 1.6% Mo, about 0.04% to about 0.43% V, about 0.02% to about 0.04% Al, about 0.001% to about 0.45% Nb, about 0.3% to about 0.5% Ti, about 0.004% to about 0.011% N, and the balance being Fe. FIG. 3 suggests that a combination of an annealing temperature T and a holding time t satisfying the relationship $900 \leqq T+20t \leqq 1{,}150$ can achieve a ridging height of about 50 $\mu$m or less.

Cold rolling is performed at a gross rolling reduction rate of about 84%, a finish to annealing temperature of about 900° C., and a holding time of about 60 seconds.

After annealing, the hot-rolled steel sheet is subjected to pickling and cold rolling to produce a cold-rolled sheet. This cold rolling step may include two or more cold rolling rim stages including intermediate annealing for production procedure reasons, if necessary. Preferably, the gross rolling reduction rate during the cold rolling is at least about 75%. The cold-rolled sheet is preferably subjected to (continuous) finish annealing at a temperature between about 800° C. and about 1,100° C. and pickling to produce a cold-rolled annealed sheet as a final product. The cold-rolled annealed sheet may be subjected to slight rolling to adjust the shape and quality of the steel sheet according to usage.

In order to omit lubricant vinyl or oil in severe processing for complicated shapes and press forming, a lubricant coat is preferably applied to the surfaces of the steel sheet in a coating amount of about 0.5 g/m$^2$ to about 4.0 g/m$^2$. The lubricant coat in the invention contains about 3 to about 20 percent by volume of calcium stearate and about 3 to about 20 percent by volume of polyethylene wax.

The applied lubricant coat improves sliding performance of the steel sheet and facilitates deep drawing into complicated shapes. Preferably, the lubricant coat is a removable type which can be readily removed with alkali. If the steel sheet containing the remaining lubricant coat is subjected to spot welding or seam welding, sensitive weld portions cause noticeable deterioration of corrosion resistance.

According to press forming testing, at least about 0.5 g/m$^2$ of lubricant coat must be applied to ensure the improvement in sliding performance. At a coating amount exceeding about 4.0 g/m$^2$, the effect of the lubricant coat is no longer enhanced. Furthermore, the steel sheet having such a high amount of lubricant coat amount is not suitable for seam welding or spot welding because the lubricant coat precludes electrical conduction in the welding process and causes excessive sensitivity at the welding portion. The coating amount of the lubricant coat on the steel sheet is preferably about 1.0 to about 2.5 g/m$^2$ in view of compatibility between weldability and processability. The lubricant coat may be applied to one side or preferably two sides of the stainless steel.

The thickness of the steel sheet made by the above production steps is preferably at least about 0.4 mm to ensure that sufficient strength is imparted to a tank filled with fuel. However, excess thickness results in a decrease in cold rolling reduction rate and r-value, thereby precluding press formability and pipe expansion. Hence, the maximum thickness is preferably about 1.0 mm. The resulting steel sheet according to the invention has an r-value of at least about 1.50 or at least about 1.90 under optimized production conditions. Thus, the steel sheet according to the invention exhibits high corrosion resistance and high toughness after the steel sheet is shaped into a fuel tank or a pipe. Fuel pipes made of the steel sheet according to the invention may be welded by any known welding method such as arc welding including tungsten inert gas (TIG) welding, metal inert gas (MIG) welding, and ERW; electric resistance welding; and laser welding.

EXAMPLES

Example 1

Steel slabs having the compositions shown in Table 1 were heated to 1,120° C., and hot-rolled to form hot-rolled sheets having a thickness in the range of 4.0 to 5.5 mm. Each hot-rolled sheet was continuously annealed (hot-rolled annealing) and then cold-rolled. The resulting cold-rolled sheet was continuously annealed (cold-rolled annealing) and subjected to pickling to remove scales. Test steel sheets were thereby prepared.

Table 2 shows process conditions, such as linear pressure of the final pass in the hot rolling, gross rolling reduction rate in the cold rolling, and annealing temperature.

The r-value of each test steel sheet was measured according to JIS-Z2254. The steel sheet was subjected to cylindrical deep drawing at a punch diameter of 33 mm and a blank diameter of 70 mm and cracking was visually observed. The deep drawn sample was immersed in deteriorated gasoline containing 1,200 ppm of formic acid and 400 ppm of acetic acid for 5 days for corrosion testing. In "Corrosion resistance to deteriorated gasoline" in Table 2, letter "A" represents a change in weight of 0.1 g/m$^2$ or less and no red rust in appearance observation, and letter "B" represents cases other than "A".

Table 2 also includes the results of other tests. Table 2 shows that the steel sheets according to the invention exhibit superior processability and high corrosion resistance to deteriorated gasoline.

TABLE 1

| Steel No. | Composition (mass %) C | Si | Mn | P | S | Al | Cr | Ni | V | Mo | Nb | Ti | N | Remarks |
|---|---|---|---|---|---|---|---|---|---|---|---|---|---|---|
| 1 | 0.004 | 0.10 | 0.18 | 0.04 | 0.01 | 0.04 | 18.2 | 0.2 | 0.06 | 1.2 | 0.002 | 0.300 | 0.010 | EX |
| 2 | 0.004 | 0.10 | 0.18 | 0.04 | 0.01 | 0.04 | 18.2 | 0.2 | 0.01 | 1.2 | 0.002 | 0.300 | 0.010 | CE |
| 3 | 0.011 | 0.14 | 0.28 | 0.03 | 0.02 | 0.03 | 17.9 | 0.3 | 0.72 | 0.7 | 0.300 | 0.200 | 0.010 | EX |
| 4 | 0.006 | 0.26 | 0.22 | 0.02 | 0.01 | 0.02 | 14.8 | 0.7 | 0.18 | 1.6 | 0.045 | 0.010 | 0.007 | EX |
| 5 | 0.007 | 0.24 | 0.25 | 0.05 | 0.02 | 0.08 | 11.2 | 0.4 | 0.05 | 2.1 | 0.05 | 0.350 | 0.009 | EX |
| 6 | 0.004 | 0.35 | 0.10 | 0.03 | 0.01 | 0.15 | 15.5 | 0.8 | 0.08 | 0.4 | 0.04 | 0.01 | 0.006 | CE |
| 7 | 0.015 | 0.45 | 0.40 | 0.04 | 0.02 | 0.02 | 17.3 | 0.4 | 0.52 | 0.8 | 0.004 | 0.004 | 0.005 | CE |

EX: Example according to the invention
CE: Comparative Example

TABLE 2

| Sheet No. | Steel No. | Hot rolling: Final pass linear pressure (MN/m) | Hot rolling: FDT (° C.) | Hot-rolled annealing: Temp. (° C.) | Hot-rolled annealing: Time (s) | Gross cold rolling reduction rate (%) | Intermediated annealing: Temp. (° C.) | Intermediated annealing: Time (s) | Cold-rolled annealing: Temp. (° C.) | Cold-rolled annealing: Time (s) |
|---|---|---|---|---|---|---|---|---|---|---|
| A | 1 | 5.8 | 780 | 980 | 60 | 84 | — | — | 920 | 60 |
| B | 1 | 3.6 | 800 | 930 | 150 | 85 | 900 | 60 | 960 | 40 |
| C | 1 | 4.2 | 820 | 910 | 100 | 76 | 900 | 60 | 890 | 75 |
| D | 1 | 4.8 | 750 | 870 | 300 | 94 | 810 | 120 | 1000 | 94 |
| E | 1 | 4.4 | 810 | 930 | 200 | 80 | 850 | 150 | 930 | 120 |
| F | 1 | 4.4 | 810 | 930 | 200 | 80 | 850 | 150 | 930 | 120 |
| G | 1 | 3.9 | 790 | 910 | 150 | 82 | — | — | 960 | 200 |
| H | 1 | 3.4 | 790 | 960 | 80 | 84 | 880 | 250 | 960 | 150 |
| I | 1 | 3.8 | 820 | 930 | 80 | 74 | 880 | 150 | 980 | 80 |
| J | 1 | 3.8 | 830 | 940 | 120 | 77 | 920 | 100 | 950 | 120 |
| K | 2 | 3.2 | 870 | 980 | 60 | 84 | — | — | 920 | 60 |
| L | 2 | 5.8 | 820 | 930 | 100 | 84 | 900 | 120 | 940 | 160 |
| M | 3 | 5.4 | 780 | 980 | 60 | 84 | — | — | 920 | 60 |
| N | 4 | 7.1 | 760 | 1020 | 60 | 87 | 990 | 60 | 970 | 60 |
| O | 5 | 3.8 | 740 | 880 | 90 | 84 | 800 | 150 | 940 | 120 |
| P | 6 | 4.2 | 810 | 950 | 60 | 83 | 850 | 120 | 950 | 80 |
| Q | 7 | 4.4 | 820 | 930 | 120 | 80 | 900 | 120 | 940 | 80 |

| Sheet No. | Low pressure rolling reduction rate (%) | Final sheet thickness (mm) | r-value | Cracking during deep drawing | Corrosion resistance to deteriorated gasoline | Remarks |
|---|---|---|---|---|---|---|
| A | — | 0.8 | 2.01 | Not observed | A | EX |
| B | — | 0.8 | 1.90 | Not observed | A | EX |
| C | — | 1.0 | 1.61 | Not observed | A | EX |
| D | — | 0.4 | 2.80 | Not observed | A | EX |
| E | — | 1.0 | 1.80 | Not observed | A | EX |
| F | 3 | 1.0 | 1.81 | Not observed | A | EX |
| G | — | 1.0 | 1.90 | Not observed | A | EX |
| H | — | 0.7 | 1.40 | Observed | A | CE |
| I | — | 1.0 | 1.20 | Observed | A | CE |
| J | — | 1.1 | 1.33 | Observed | A | EX |
| K | — | 0.8 | 1.41 | Observed | B | CE |
| L | — | 0.8 | 1.60 | Not observed | B | CE |
| M | — | 0.8 | 1.60 | Not observed | A | EX |
| N | — | 0.6 | 1.91 | Not observed | A | EX |
| O | — | 0.7 | 2.00 | Not observed | A | EX |
| P | — | 0.8 | 1.93 | Not observed | B | CE |
| Q | — | 1.0 | 1.20 | Observed | A | CE |

EX: Example according to the invention
CE: Comparative Example

Example 2

Steel slabs having the compositions shown in Table 3 were heated to 1,120° C., and hot-rolled at a final hot-rolling temperature of 780° C. to form hot-rolled sheets having a thickness of 5.0 mm. Each hot-rolled sheet was annealed under the conditions shown in Table 4, subjected to pickling for descaling, and then cold-rolled into a thickness of 0.8 mm. The gross reduction rate in the cold rolling step was 84%. The resulting cold-rolled sheet was finish-annealed at 900° C. or more and subjected to pickling to remove scales. Test steel sheets were thereby prepared.

Tensile test pieces were prepared from each steel sheet such that the stretching direction corresponded to the rolling direction. One of the test pieces was deformed by 25% by uniaxial stretching. The height of ridges generated on the surface of the deformed steel sheet was measured in the direction perpendicular to the stretching direction. Another test piece was subjected to a bulging test with a 100-mm diameter spherical punch and a commercially available lubricant oil in which the bulged height when a crack was formed was measured, as press formability. Another test piece was prepared from each steel sheet and immersed in a deteriorated gasoline containing 1,200 ppm of formic acid and 400 ppm of acetic acid for 5 days for corrosion testing. In "Corrosion resistance to deteriorated gasoline" in Table 2, letter "A" represents a change in weight of 0.1 g/m$^2$ or less and no red rust in appearance observation, and "B" represents cases other than "A". Table 4 also includes the results of these tests.

Table 4 shows that each sheet according to the invention has a small ridging height and thus exhibits superior processability.

mance of test pieces prepared from each sheet were examined. The results are shown in Table 5.

In the sliding performance testing, a test piece with a length of 300 mm and a width of 10 mm was disposed between flat dies with a contact area with the test piece of 200 mm$^2$ under an area pressure of 8 kgf/mm$^2$ and a dynamic friction coefficient ($\mu$) was determined by a pulling-out force (F). The spot weldability was evaluated by a nugget diameter at the welded portion of two test pieces with a thickness of 0.8 mm which were welded using a chromium-copper alloy (diameter=16 mm) and a R type electrode (radius=40 mm) at a current of 5 kA under a pressure of 2 KN. A nugget diameter of 3✓t or less was evaluated as unsatisfactory welding performance (B) and a

TABLE 3

| Steel | Composition (mass %) | | | | | | | | | | | | |
|---|---|---|---|---|---|---|---|---|---|---|---|---|---|
| No. | C | Si | Mn | P | S | Al | Cr | Ni | Mo | V | Nb | Ti | N |
| A | 0.004 | 0.70 | 0.18 | 0.04 | 0.01 | 0.04 | 18.2 | 0.2 | 2.1 | 0.06 | 0.60 | 0.30 | 0.010 |
| B | 0.011 | 0.14 | 1.20 | 0.03 | 0.02 | 0.03 | 17.9 | 0.3 | 0.7 | 0.72 | 0.30 | 0.20 | 0.010 |
| C | 0.006 | 0.26 | 0.22 | 0.02 | 0.007 | 0.02 | 14.8 | 1.4 | 1.6 | 0.80 | 0.045 | 0.003 | 0.007 |
| D | 0.080 | 0.10 | 0.28 | 0.04 | 0.01 | 0.40 | 11.8 | 0.7 | 1.2 | 0.18 | 0.002 | 0.05 | 0.020 |
| E | 0.004 | 0.70 | 0.19 | 0.03 | 0.01 | 0.03 | 18.3 | 0.2 | 0.4 | 0.07 | 0.60 | 0.31 | 0.010 |
| F | 0.005 | 0.69 | 0.18 | 0.04 | 0.01 | 0.03 | 18.2 | 0.2 | 1.3 | 0.003 | 0.50 | 0.30 | 0.010 |

TABLE 4

| Sheet No. | Steel No. | Hot-rolled annealing Temp. (° C.) | Hot-rolled annealing Time (m) | Ridging height ($\mu$m) | Bulged height (mm) | *) Evaluation | Corrosion resistance to deteriorated gasoline | Remarks |
|---|---|---|---|---|---|---|---|---|
| 1 | A | 1100 | 0.5 | 40 | 38 | H | A | EX |
| 2 | A | 1000 | 0.5 | 38 | 43 | H | A | EX |
| 3 | A | 900 | 0.5 | 39 | 37 | H | A | EX |
| 4 | A | 750 | 0.5 | 48 | 33 | M | A | EX |
| 5 | B | 1000 | 2.0 | 33 | 46 | H | A | EX |
| 6 | B | 900 | 2.0 | 32 | 49 | H | A | EX |
| 7 | B | 1000 | 3.0 | 29 | 49 | H | A | EX |
| 8 | B | 750 | 2.0 | 47 | 34 | M | A | EX |
| 9 | C | 850 | 4.0 | 24 | 51 | H | A | EX |
| 10 | C | 800 | 6.0 | 35 | 43 | H | A | EX |
| 11 | C | 950 | 6.5 | 36 | 49 | H | A | EX |
| 12 | C | 1100 | 5.0 | 59 | 26 | L | A | CE |
| 13 | D | 850 | 7.0 | 45 | 44 | H | A | EX |
| 14 | D | 800 | 8.0 | 42 | 46 | H | A | EX |
| 15 | D | 850 | 9.5 | 46 | 39 | H | A | EX |
| 16 | D | 800 | 9.5 | 45 | 38 | H | A | EX |
| 17 | D | 1150 | 8.5 | 54 | 24 | L | A | CE |
| 18 | D | 1000 | 8.5 | 61 | 22 | L | A | CE |
| 19 | E | 1000 | 0.5 | 40 | 42 | H | B | CE |
| 20 | F | 900 | 0.5 | 38 | 36 | H | B | CE |

*)Evaluation standard
H: bulged height ≧ 35 $\mu$m
M: 35 $\mu$m > bulged height ≧ 30 $\mu$m
L: 30 $\mu$m > bulged height

Example 3

Cold-rolled steel sheets A (thickness: 0.8 mm) shown in Table 2 in Example 1 were washed with an alkaline solution, and various amounts of lubricant coat containing an acrylic resin as a main component, 5 percent by volume of calcium stearate, and 5 percent by volume of polyethylene wax were applied to these steel sheets. Each sheet was baked at 80±5° C. for 15 seconds. The spot weldability and sliding perfornugget diameter exceeding 3✓t was evaluated as satisfactory welding performance (A) wherein t means the sheet thickness.

According to the results, at least about 0.5 g/m$^2$ of lubricant coat must be applied to improve the sliding performance. However, at a coating amount exceeding about 4.0 g/m$^2$, the improvement in sliding performance is saturated and weldability precluded due to poor electrical conductivity during the spot welding.

TABLE 5

| Coating amount ($g/m^2$) | Sliding test (Dynamic friction coefficient: $\mu$) | Weldability (Nugget diameter) |
|---|---|---|
| 0.2 | 0.265 | A |
| 0.4 | 0.166 | A |
| 0.5 | 0.102 | A |
| 0.8 | 0.101 | A |
| 1.5 | 0.099 | A |
| 2.2 | 0.097 | A |
| 2.8 | 0.097 | A |
| 3.8 | 0.098 | A |
| 4.2 | 0.097 | B |
| 5.0 | 0.097 | B |

B: $\leqq 3\sqrt{t}$, $A > 3\sqrt{t}$
(t: thickness)

As described above, the ferritic stainless steel sheet according to the invention exhibits superior processability and high corrosion resistance to deteriorated gasoline. Thus, containers and piping elements produced using this steel sheet can be safely used in severe environments, for example, in the presence of deteriorated gasoline or methanol.

What is claimed is:

1. A ferritic stainless steel sheet for fuel tanks and fuel pipes comprising, by mass percent: about 0.1% or less of C; about 1.0% or less of Si; about 1.5% or less of Mn; about 0.06% or less of P; about 0.03% or less of S; about 1.0% or less of Al; about 11% to about 20% Cr; about 0.2% to about 2.0% of Ni; about 0.5% to about 3.0% Mo; about 0.05% to about 0.3% V; about 0.04% or less of N; at least one of about 0.01% to about 0.8% Nb and about 0.01% to about 1.0% Ti; and the balance being Fe and incidental impurities, wherein said steel sheet has a ridging height of 50 $\mu$m or less and an r-value of at least 1.5.

2. The ferritic stainless steel sheet according to claim 1, wherein the ferritic stainless steel sheet has a ridging height of about 50 $\mu$m or less at a 25% deformation in uniaxial stretching.

3. A fuel tank comprising the ferritic stainless steel sheet according to claim 1.

4. A fuel pipe comprising the ferritic stainless steel sheet according to claim 1.

* * * * *